US009938610B2

(12) United States Patent
Helmink et al.

(10) Patent No.: US 9,938,610 B2
(45) Date of Patent: Apr. 10, 2018

(54) HIGH TEMPERATURE NIOBIUM-BEARING SUPERALLOYS

(71) Applicants: Rolls-Royce Corporation, Indianapolis, IN (US); Illinois Institute of Technology, Chicago, IL (US)

(72) Inventors: Randolph C. Helmink, Avon, IN (US); Sammy Tin, Wheaton, IL (US)

(73) Assignees: Rolls-Royce Corporation, Indianapolis, IN (US); Illinois Institute of Technology, Chicago, IL (US)

( * ) Notice: Subject to any disclaimer, the term of this patent is extended or adjusted under 35 U.S.C. 154(b) by 305 days.

(21) Appl. No.: 14/490,103

(22) Filed: Sep. 18, 2014

(65) Prior Publication Data

US 2015/0167124 A1 Jun. 18, 2015

Related U.S. Application Data

(60) Provisional application No. 61/880,478, filed on Sep. 20, 2013.

(51) Int. Cl.
*C22C 19/05* (2006.01)
*C22C 19/00* (2006.01)

(52) U.S. Cl.
CPC ..... *C22C 19/057* (2013.01); *C22C 19/007* (2013.01); *C22C 19/05* (2013.01); *C22C 19/056* (2013.01)

(58) Field of Classification Search
CPC ..... C22C 19/007; C22C 19/05; C22C 19/056; C22C 19/057
USPC ..... 420/445
See application file for complete search history.

(56) References Cited

U.S. PATENT DOCUMENTS

| | | | |
|---|---|---|---|
| 3,649,379 | A | 3/1972 | Kotval |
| 3,700,427 | A | 10/1972 | Baker et al. |
| 3,838,981 | A | 10/1974 | Foley et al. |
| 3,890,816 | A | 6/1975 | Allen |
| 3,917,463 | A | 11/1975 | Doi et al. |
| 3,929,467 | A | 12/1975 | Davies et al. |
| 3,985,582 | A | 10/1976 | Bibring et al. |
| 4,012,241 | A | 3/1977 | Lemkey |
| 4,084,161 | A | 4/1978 | Manning |
| 4,439,236 | A | 3/1984 | Ray |
| 4,451,431 | A | 5/1984 | Naik |
| 4,556,534 | A | 12/1985 | Burnett et al. |
| 4,556,607 | A | 12/1985 | Sastri |
| 4,569,824 | A | 2/1986 | Duhl |
| 4,585,620 | A | 4/1986 | Kamohara et al. |
| 4,795,504 | A | 1/1989 | Slaney et al. |
| 4,854,980 | A | 8/1989 | Raman et al. |
| 4,883,640 | A | 11/1989 | Mizuhara |

(Continued)

FOREIGN PATENT DOCUMENTS

JP 11310839 A * 11/1999

OTHER PUBLICATIONS

Tamaoki et al., English machine translation of JP 11-310839A, Nov. 1999, p. 1-19.*

(Continued)

*Primary Examiner* — Jie Yang
(74) *Attorney, Agent, or Firm* — Barnes & Thornburg LLP

(57) ABSTRACT

Nickel-base superalloys having gamma prime strengthening precipitates in a gamma matrix and little or no tertiary incoherent phases, such as delta, delta variants and eta.

20 Claims, 7 Drawing Sheets

(56) References Cited

U.S. PATENT DOCUMENTS

| | | | |
|---|---|---|---|
| 4,931,255 | A | 6/1990 | Doherty et al. |
| 4,981,644 | A | 1/1991 | Chang |
| 5,133,993 | A | 7/1992 | Streckert |
| 5,401,307 | A | 3/1995 | Czech et al. |
| 5,582,635 | A | 12/1996 | Czech et al. |
| 5,599,385 | A | 2/1997 | Czech et al. |
| 5,686,178 | A | 11/1997 | Stevens et al. |
| 5,786,785 | A | 7/1998 | Gindrup et al. |
| 5,866,273 | A | 2/1999 | Wiggins et al. |
| 5,892,476 | A | 4/1999 | Gindrup et al. |
| 6,017,628 | A | 1/2000 | Stevens et al. |
| 6,177,046 | B1 | 1/2001 | Simkovich et al. |
| 6,521,175 | B1 | 2/2003 | Mourer et al. |
| 6,730,264 | B2 | 5/2004 | Cao |
| 6,797,401 | B2 | 9/2004 | Herron |
| 6,909,395 | B1 | 6/2005 | Carpenter |
| 7,060,241 | B2 | 6/2006 | Glatkowski |
| 7,192,537 | B2 | 3/2007 | Lucas |
| 7,247,368 | B1 | 7/2007 | Rogers |
| 7,345,616 | B2 | 3/2008 | Williams |
| 7,378,132 | B2 | 5/2008 | Renteria et al. |
| 7,491,275 | B2 | 2/2009 | Cao et al. |
| 7,531,054 | B2 | 5/2009 | Kennedy et al. |
| 7,612,138 | B2 | 11/2009 | Kuznetsov et al. |
| 7,633,424 | B1 | 12/2009 | Hill |
| 7,678,465 | B2 | 3/2010 | Sambasivan et al. |
| 8,031,104 | B2 | 10/2011 | Janis |
| 8,101,122 | B2 | 1/2012 | Hawk |
| 8,124,184 | B2 | 2/2012 | Sambasivan et al. |
| 8,147,749 | B2 | 4/2012 | Reynolds |
| 8,349,250 | B2 | 1/2013 | Suzuki et al. |
| 8,858,874 | B2 * | 10/2014 | Tin ..... C22C 19/05 420/445 |
| 2003/0136478 | A1 | 7/2003 | Mitarai et al. |
| 2004/0005483 | A1 | 1/2004 | Lin |
| 2004/0011245 | A1 | 1/2004 | Sambasivan et al. |
| 2007/0065676 | A1 | 3/2007 | Bacalski et al. |
| 2009/0136381 | A1 | 5/2009 | Tin et al. |
| 2010/0038412 | A1 | 2/2010 | Huang |
| 2011/0200838 | A1 | 8/2011 | Thomas et al. |
| 2012/0027607 | A1 | 2/2012 | DiDomizio et al. |
| 2012/0267420 | A1 | 10/2012 | Cheney |
| 2013/0052077 | A1 | 2/2013 | Hardy |

OTHER PUBLICATIONS

Xie, et al., "Strucutre Stability Study on a Newly Developed Nickel-Base Superalloy—AIIVAC 718PLUS", TMS (The Minerals, Metals & Materials Society), 2005.

* cited by examiner

HIGH TEMPERATURE NIOBIUM-BEARING SUPERALLOYS

CROSS-REFERENCE TO RELATED APPLICATIONS

This application claims the benefit under 35 U.S.C. § 119(e) of U.S. Provisional Application Ser. No. 61/880,478, filed on Sep. 20, 2013, the entire disclosure of which is incorporated herein by reference.

FIELD OF THE DISCLOSURE

The present disclosure relates generally to superalloys. More specifically, the present disclosure relates to nickel-base niobium-bearing superalloys having high strength and improved ductility and resistance to degradation at elevated temperatures.

BACKGROUND

There is a continuing need for alloys to enable disk rotors in gas turbine engines, such as those in the high pressure compressors and turbines, to operate at higher compressor outlet temperatures and faster shaft speeds. The higher temperatures and increased shaft speeds facilitate the high climb rates that are increasingly required by commercial airlines to move aircraft more quickly to altitude, to reduce fuel burn and to clear the busy air spaces around airports. These operating conditions give rise to fatigue cycles with long dwell periods at elevated temperatures, in which oxidation and time dependent deformation can significantly decrease resistance to low cycle fatigue. As a result, there is a need to improve the resistance of alloys to surface environmental damage and dwell fatigue crack growth, and to increase proof strength, without compromising their other mechanical and physical properties or increasing their density.

Conventional high pressure compressor disks and/or high pressure turbine disks of gas turbine engines are often produced from high strength nickel-base superalloys. These materials are often highly alloyed with refractory elements to enhance strength and precipitate a high volume fraction of gamma prime strengthening phase into the gamma phase. The grain structure of such alloys is typically designed to optimize strength and low cycle fatigue performance and/or resistance to fatigue crack growth and creep deformation by controlling heat treat parameters. Examples of highly alloyed nickel-base superalloys are discussed in U.S. Pat. No. 6,132,527; U.S. Pat. No. 6,521,175; and U.S. Pat. No. 6,969,431. As the overall level of refractory alloying elements increases in such alloys, the microstructure can become thermodynamically unstable, such that microstructural changes occurring during operation can reduce mechanical properties of the alloys.

Future gas turbine engine components likely will be required to operate at higher temperatures and/or higher stresses than existing ones. Presently available nickel-base superalloys may be unable to meet these future operating requirements. Various alloys have emerged as potential candidates for future gas turbine engine turbine and/or compressor disks. Examples of such alloys, which typically employ third phase precipitation of delta or eta phase to enhance high temperature mechanical properties, are discussed in U.S. Patent Application Publication No. 2012/0027607 A1; U.S. Pat. No. 8,147,749; U.S. Patent Application Publication No. 2013/0052077 A1 and U.S. Patent Application Publication No. 2009/0136381 A1. However, the strength, stability or ductility of some of these materials may not be adequate for the high stresses and highly multi-axial stress states encountered by compressor and turbine disks in operation and the high tantalum content, a heavy and expensive element, in some of the alloys could adversely affect cost and density. Additionally, decohesion at the interface of the matrix and third phase precipitates during high temperature thermomechanical processing or during service operation could cause premature failure of the highly stressed rotating components.

SUMMARY

The present application discloses one or more of the features recited in the appended claims and/or the following features which, alone or in any combination, may comprise patentable subject matter.

A niobium bearing superalloy may consist of 2.2 to 4 wt. % aluminum, 0.01 to 0.05 wt. % boron, 0.02 to 0.06 wt. % carbon, 6 to 15 wt. % chromium, 0 to 20 wt. % cobalt, 0 to 0.5 wt. % hafnium, 1 to 3 wt. % molybdenum, 7.2 to 16 wt. % niobium, 0 to 0.6 wt % silicon, 1 to 5 wt. % tantalum, 0 to 1.5 wt. % titanium, 1 to 3 wt. % tungsten, 0.04 to 0.1 wt. % zirconium and the balance nickel and incidental impurities.

A niobium bearing superalloy may consist of 2.5 to 5 wt. % aluminum, 0.01 to 0.05 wt. % boron, 0.02 to 0.06 wt. % carbon, 8 to 15 wt. % chromium, 0 to 20 wt. % cobalt, 0 to 0.5 wt. % hafnium, 1 to 3 wt. % molybdenum, 6 to 12 wt. % niobium, 0 to 0.6 wt % silicon, 1 to 5 wt. % tantalum, 0 to 1.5 wt. % titanium, 1 to 3 wt. % tungsten, 0.04 to 0.1 wt. % zirconium and the balance nickel and incidental impurities.

In some embodiments the niobium bearing superalloy consists of 2.8 to 4 wt. % aluminum, 0.01 to 0.05 wt. % boron, 0.02 to 0.06 wt. % carbon, 10 to 15 wt. % chromium, 8 to 20 wt. % cobalt, 0 to 0.5 wt. % hafnium, 1 to 3 wt. % molybdenum, 7.2 to 12.5 wt. % niobium, 0 to 0.6 wt % silicon, 1 to 5 wt. % tantalum, 0 to 0.5 wt. % titanium, 1 to 3 wt. % tungsten, 0.04 to 0.1 wt. % zirconium and the balance nickel and incidental impurities.

In some embodiments the niobium bearing superalloy consists of 3 to 4.5 wt. % aluminum, 0.01 to 0.05 wt. % boron, 0.02 to 0.06 wt. % carbon, 10 to 15 wt. % chromium, 8 to 20 wt. % cobalt, 0 to 0.5 wt. % hafnium, 1 to 3 wt. % molybdenum, 6 to 9.5 wt. % niobium, 0 to 0.6 wt % silicon, 1 to 5 wt. % tantalum, 0 to 0.5 wt. % titanium, 1 to 3 wt. % tungsten, 0.04 to 0.1 wt. % zirconium and the balance nickel and incidental impurities.

In some embodiments the niobium bearing superalloy consists of 3.2 to 3.6 wt. % aluminum, 0.01 to 0.05 wt. % boron, 0.02 to 0.06 wt. % carbon, 11 to 13.5 wt. % chromium, 10 to 20 wt. % cobalt, 0 to 0.5 wt. % hafnium, 1 to 3 wt. % molybdenum, 7.2 to 12.5 wt. % niobium, 0 to 0.6 wt % silicon, 1 to 5 wt. % tantalum, 0 to 0.5 wt. % titanium, 1 to 3 wt. % tungsten, 0.04 to 0.1 wt. % zirconium and the balance nickel and incidental impurities.

In some embodiments the niobium bearing superalloy consists of 3.5 to 4.5 wt. % aluminum, 0.01 to 0.05 wt. % boron, 0.02 to 0.06 wt. % carbon, 11 to 13.5 wt. % chromium, 10 to 18 wt. % cobalt, 0 to 0.5 wt. % hafnium, 1 to 3 wt. % molybdenum, 6.5 to 8.5 wt. % niobium, 0 to 0.6 wt % silicon, 1 to 5 wt. % tantalum, 0 to 0.5 wt. % titanium, 1 to 3 wt. % tungsten, 0.04 to 0.1 wt. % zirconium and the balance nickel and incidental impurities.

In some embodiments the niobium bearing superalloy includes 3.3 wt. aluminum, 9.0 wt. % chromium and 9.6 wt. % niobium.

In some embodiments the niobium bearing superalloy includes 3.8 wt. % aluminum, 9.1 wt. % chromium and 8.1 wt. % niobium.

In some embodiments the niobium bearing superalloy includes 2.8 wt. % aluminum, 8.9 wt. % chromium and 11.1 wt. % niobium.

In some embodiments the niobium bearing superalloy includes 3.2 wt. aluminum, 4.5 wt. % chromium and 9.6 wt. % niobium.

In some embodiments the niobium bearing superalloy includes 3.3 wt. % aluminum, 13.6 wt. % chromium and 9.7 wt. % niobium.

In some embodiments the niobium bearing superalloy includes 3.2 wt. % aluminum, 8.8 wt. % chromium and 8.7 wt. % niobium.

In some embodiments the niobium bearing superalloy includes 3.1 wt. % aluminum, 8.6 wt. % chromium, 8.5 wt. % niobium, 2.4 wt. % molybdenum, 2.3 wt. % tungsten, 3.0 wt. % tantalum and 17.6 wt. % cobalt.

In some embodiments the niobium bearing superalloy includes 3.2 wt. % aluminum, 8.7 wt. % chromium, 9.3 wt. % niobium, 2.4 wt. % molybdenum, 2.3 wt. % tungsten, 1.5 wt. % tantalum and 17.7 wt. % cobalt.

In some embodiments the niobium bearing superalloy includes 3.1 wt. % aluminum, 8.5 wt. % chromium, 7.6 wt. % niobium, 2.4 wt. % molybdenum, 2.3 wt. % tungsten, 4.5 wt. % tantalum and 17.4 wt. % cobalt.

In some embodiments the niobium bearing superalloy includes 3.4 wt. % aluminum, 12.1 wt. % chromium, 8.5 wt. % niobium, 2.4 wt. % molybdenum, 2.3 wt. % tungsten, 3.0 wt. % tantalum and 17.7 wt. % cobalt.

In some embodiments the niobium bearing superalloy includes 3.4 wt. % aluminum, 12.1 wt. % chromium, 8.5 wt. % niobium, 2.4 wt. % molybdenum, 2.3 wt. % tungsten and 3.0 wt. % tantalum.

In some embodiments the niobium bearing superalloy includes 3.4 wt. % aluminum, 8.6 wt. % chromium, 8.5 wt. % niobium, 2.4 wt. % molybdenum, 2.3 wt. % tungsten and 3.0 wt. % tantalum.

In some embodiments the niobium bearing superalloy includes 3.4 wt. % aluminum, 12.1 wt. % chromium, 8.5 wt. % niobium, 2.4 wt. % molybdenum, 2.3 wt. % tungsten, 3.0 wt. % tantalum and 8.8 wt. % cobalt.

In some embodiments the niobium bearing superalloy includes 3.4 wt. % aluminum, 12.2 wt. % chromium, 9.4 wt. % niobium, 2.4 wt. % molybdenum, 2.3 wt. % tungsten and 1.5 wt. % tantalum.

In some embodiments the niobium bearing superalloy includes 3.6 wt. % aluminum, 12.2 wt. % chromium, 8.5 wt. % niobium, 2.4 wt. % molybdenum, 2.3 wt. % tungsten and 3.0 wt. % tantalum.

In some embodiments the niobium bearing superalloy includes 3.4 wt. % aluminum, 12.1 wt. % chromium, 8.5 wt. % niobium, 2.4 wt. % molybdenum, 2.3 wt. % tungsten, 3.0 wt. % tantalum and 11.8 wt. % cobalt.

In some embodiments the niobium bearing superalloy includes 3.7 wt. % aluminum, 12.4 wt. % chromium, 8.7 wt. % niobium, 2.5 wt. % molybdenum, 2.3 wt. % tungsten, 3.1 wt. % tantalum and 16.1 wt. % cobalt.

In some embodiments the niobium bearing superalloy includes 3.9 wt. % aluminum, 12.4 wt. % chromium, 8.7 wt. % niobium, 2.5 wt. % molybdenum, 2.3 wt. % tungsten, 3.1 wt. % tantalum and 16.1 wt. % cobalt.

In some embodiments the niobium bearing superalloy includes 3.6 wt. % aluminum, 12.1 wt. % chromium, 9.3 wt. % niobium, 2.4 wt. % molybdenum, 2.3 wt. % tungsten, and 3.0 wt. % tantalum.

In some embodiments the niobium bearing superalloy includes 3.6 wt. % aluminum, 12.2 wt. % chromium, 8.5 wt. % niobium, 2.4 wt. % molybdenum, 2.3 wt. % tungsten, 3.0 wt. % tantalum and 11.8 wt. % cobalt.

In some embodiments the niobium bearing superalloy includes 3.8 wt. % aluminum, 12.2 wt. % chromium, 8.6 wt. % niobium, 2.4 wt. % molybdenum, 2.3 wt. % tungsten, 3.0 wt. % tantalum and 11.8 wt. % cobalt.

In some embodiments the niobium bearing superalloy includes 4.1 wt. % aluminum, 12.2 wt. % chromium, 8.6 wt. % niobium, 2.4 wt. % molybdenum, 2.3 wt. % tungsten, 3.0 wt. % tantalum and 11.9 wt. % cobalt.

In some embodiments the niobium bearing superalloy includes 4.3 wt. % aluminum, 12.3 wt. % chromium, 8.6 wt. % niobium, 2.4 wt. % molybdenum, 2.3 wt. % tungsten, 3.0 wt. % tantalum and 11.9 wt. % cobalt.

In some embodiments the niobium bearing superalloy includes 4.1 wt. % aluminum, 12.3 wt. % chromium, 7.1 wt. % niobium, 2.4 wt. % molybdenum, 2.3 wt. % tungsten, 3.1 wt. % tantalum and 17.9 wt. % cobalt.

In some embodiments the niobium bearing superalloy includes 4.1 wt. % aluminum, 12.3 wt. % chromium, 7.1 wt. % niobium, 2.4 wt. % molybdenum, 2.3 wt. % tungsten, 3.1 wt. % tantalum and 11.9 wt. % cobalt.

In some embodiments the niobium bearing superalloy includes 4.1 wt. % aluminum, 10.5 wt. % chromium, 7.0 wt. % niobium, 2.4 wt. % molybdenum, 2.3 wt. % tungsten, 3.0 wt. % tantalum and 17.9 wt. % cobalt.

In some embodiments the niobium bearing superalloy includes 3.6 wt. aluminum, 12.1 wt. % chromium, 7.0 wt. % niobium, 2.4 wt. % molybdenum, 2.3 wt. % tungsten, 3.0 wt. % tantalum and 17.7 wt. % cobalt.

A niobium bearing superalloy may include about of 2.2 to 4 wt. % aluminum, about 0.01 to 0.05 wt. % boron, about 0.02 to 0.06 wt. % carbon, about 6 to 15 wt. % chromium, about 0 to 20 wt. % cobalt, about 0 to 0.5 wt. % hafnium, about 1 to 3 wt. % molybdenum, about 7.2 to 16 wt. % niobium, about 0 to 0.6 wt % silicon, about 1 to 5 wt. % tantalum, about 0 to 1.5 wt. % titanium, about 1 to 3 wt. % tungsten, about 0.04 to 0.1 wt. % zirconium and the balance nickel and incidental impurities.

A niobium bearing superalloy may include about of 2.5 to 5 wt. % aluminum, about 0.01 to 0.05 wt. % boron, about 0.02 to 0.06 wt. % carbon, about 8 to 15 wt. % chromium, about 0 to 20 wt. % cobalt, about 0 to 0.5 wt. % hafnium, about 1 to 3 wt. % molybdenum, about 6 to 12 wt. % niobium, about 0 to 0.6 wt % silicon, about 1 to 5 wt. % tantalum, about 0 to 1.5 wt. % titanium, about 1 to 3 wt. % tungsten, about 0.04 to 0.1 wt. % zirconium and the balance nickel and incidental impurities.

In some embodiments the niobium bearing superalloy includes about 2.8 to 4 wt. % aluminum, about 0.01 to 0.05 wt. % boron, about 0.02 to 0.06 wt. % carbon, about 10 to 15 wt. % chromium, about 8 to 20 wt. % cobalt, about 0 to 0.5 wt. % hafnium, about 1 to 3 wt. % molybdenum, about 7.2 to 12.5 wt. % niobium, about 0 to 0.6 wt % silicon, about 1 to 5 wt. % tantalum, about 0 to 0.5 wt. % titanium, about 1 to 3 wt. % tungsten, about 0.04 to 0.1 wt. % zirconium and the balance nickel and incidental impurities.

In some embodiments the niobium bearing superalloy includes about 3 to 4.5 wt. % aluminum, about 0.01 to 0.05 wt. % boron, about 0.02 to 0.06 wt. % carbon, about 10 to 15 wt. % chromium, about 8 to 20 wt. % cobalt, about 0 to 0.5 wt. % hafnium, about 1 to 3 wt. % molybdenum, about 6 to 9.5 wt. % niobium, about 0 to 0.6 wt % silicon, about 1 to 5 wt. % tantalum, about 0 to 0.5 wt. % titanium, about 1 to 3 wt. % tungsten, about 0.04 to 0.1 wt. % zirconium and the balance nickel and incidental impurities.

In some embodiments the niobium bearing superalloy includes about 3.2 to 3.6 wt. % aluminum, about 0.01 to 0.05 wt. % boron, about 0.02 to 0.06 wt. % carbon, about 11 to 13.5 wt. % chromium, about 10 to 20 wt. % cobalt, about 0 to 0.5 wt. % hafnium, about 1 to 3 wt. % molybdenum, about 7.2 to 12.5 wt. % niobium, about 0 to 0.6 wt % silicon, about 1 to 5 wt. % tantalum, about 0 to 0.5 wt. % titanium, about 1 to 3 wt. % tungsten, about 0.04 to 0.1 wt. % zirconium and the balance nickel and incidental impurities.

In some embodiments the niobium bearing superalloy includes about 3.5 to 4.5 wt. % aluminum, about 0.01 to 0.05 wt. % boron, about 0.02 to 0.06 wt. % carbon, about 11 to 13.5 wt. % chromium, about 10 to 18 wt. % cobalt, about 0 to 0.5 wt. % hafnium, about 1 to 3 wt. % molybdenum, about 6.5 to 8.5 wt. % niobium, about 0 to 0.6 wt % silicon, about 1 to 5 wt. % tantalum, about 0 to 0.5 wt. % titanium, about 1 to 3 wt. % tungsten, about 0.04 to 0.1 wt. % zirconium and the balance nickel and incidental impurities.

In some embodiments the niobium bearing superalloy includes about 3.3 wt. % aluminum, about 9.0 wt. % chromium and about 9.6 wt. % niobium.

In some embodiments the niobium bearing superalloy includes about 3.8 wt. % aluminum, about 9.1 wt. % chromium and about 8.1 wt. % niobium.

In some embodiments the niobium bearing superalloy includes about 2.8 wt. % aluminum, about 8.9 wt. % chromium and about 11.1 wt. % niobium.

In some embodiments the niobium bearing superalloy includes about 3.2 wt. % aluminum, about 4.5 wt. % chromium and about 9.6 wt. % niobium.

In some embodiments the niobium bearing superalloy includes about 3.3 wt. % aluminum, about 13.6 wt. % chromium and about 9.7 wt. % niobium.

In some embodiments the niobium bearing superalloy includes about 3.2 wt. % aluminum, about 8.8 wt. % chromium and about 8.7 wt. % niobium.

In some embodiments the niobium bearing superalloy includes about 3.1 wt. % aluminum, about 8.6 wt. % chromium, about 8.5 wt. % niobium, about 2.4 wt. % molybdenum, about 2.3 wt. % tungsten, about 3.0 wt. % tantalum and about 17.6 wt. % cobalt.

In some embodiments the niobium bearing superalloy includes about 3.2 wt. % aluminum, about 8.7 wt. % chromium, about 9.3 wt. % niobium, about 2.4 wt. % molybdenum, about 2.3 wt. % tungsten, about 1.5 wt. % tantalum and about 17.7 wt. % cobalt.

In some embodiments the niobium bearing superalloy includes about 3.1 wt. % aluminum, about 8.5 wt. % chromium, about 7.6 wt. % niobium, about 2.4 wt. % molybdenum, about 2.3 wt. % tungsten, about 4.5 wt. % tantalum and about 17.4 wt. % cobalt.

In some embodiments the niobium bearing superalloy includes about 3.4 wt. % aluminum, about 12.1 wt. % chromium, about 8.5 wt. % niobium, about 2.4 wt. % molybdenum, about 2.3 wt. % tungsten, about 3.0 wt. % tantalum and about 17.7 wt. % cobalt.

In some embodiments the niobium bearing superalloy includes about 3.4 wt. % aluminum, about 12.1 wt. % chromium, about 8.5 wt. % niobium, about 2.4 wt. % molybdenum, about 2.3 wt. % tungsten and about 3.0 wt. % tantalum.

In some embodiments the niobium bearing superalloy includes about 3.4 wt. % aluminum, about 8.6 wt. % chromium, about 8.5 wt. % niobium, about 2.4 wt. % molybdenum, about 2.3 wt. % tungsten and about 3.0 wt. % tantalum.

In some embodiments the niobium bearing superalloy includes about 3.4 wt. % aluminum, about 12.1 wt. % chromium, about 8.5 wt. % niobium, about 2.4 wt. % molybdenum, about 2.3 wt. % tungsten, about 3.0 wt. % tantalum and about 8.8 wt. % cobalt.

In some embodiments the niobium bearing superalloy includes about 3.4 wt. % aluminum, about 12.2 wt. % chromium, about 9.4 wt. % niobium, about 2.4 wt. % molybdenum, about 2.3 wt. % tungsten and about 1.5 wt. % tantalum.

In some embodiments the niobium bearing superalloy includes about 3.6 wt. % aluminum, about 12.2 wt. % chromium, about 8.5 wt. % niobium, about 2.4 wt. % molybdenum, about 2.3 wt. % tungsten and about 3.0 wt. % tantalum.

In some embodiments the niobium bearing superalloy includes about 3.4 wt. % aluminum, about 12.1 wt. % chromium, about 8.5 wt. % niobium, about 2.4 wt. % molybdenum, about 2.3 wt. % tungsten, about 3.0 wt. % tantalum and about 11.8 wt. % cobalt.

In some embodiments the niobium bearing superalloy includes 3.7 wt. aluminum, about 12.4 wt. % chromium, about 8.7 wt. % niobium, about 2.5 wt. % molybdenum, about 2.3 wt. % tungsten, about 3.1 wt. % tantalum and about 16.1 wt. % cobalt.

In some embodiments the niobium bearing superalloy includes 3.9 wt. aluminum, about 12.4 wt. % chromium, about 8.7 wt. % niobium, about 2.5 wt. % molybdenum, about 2.3 wt. % tungsten, about 3.1 wt. % tantalum and about 16.1 wt. % cobalt.

In some embodiments the niobium bearing superalloy includes 3.6 wt. % aluminum, about 12.1 wt. % chromium, about 9.3 wt. % niobium, about 2.4 wt. % molybdenum, about 2.3 wt. % tungsten, about and about 3.0 wt. % tantalum.

In some embodiments the niobium bearing superalloy includes 3.6 wt. % aluminum, about 12.2 wt. % chromium, about 8.5 wt. % niobium, about 2.4 wt. % molybdenum, about 2.3 wt. % tungsten, about 3.0 wt. % tantalum and about 11.8 wt. % cobalt.

In some embodiments the niobium bearing superalloy includes 3.8 wt. % aluminum, about 12.2 wt. % chromium, about 8.6 wt. % niobium, about 2.4 wt. % molybdenum, about 2.3 wt. % tungsten, about 3.0 wt. % tantalum and about 11.8 wt. % cobalt.

In some embodiments the niobium bearing superalloy includes 4.1 wt. % aluminum, about 12.2 wt. % chromium, about 8.6 wt. % niobium, about 2.4 wt. % molybdenum, about 2.3 wt. % tungsten, about 3.0 wt. % tantalum and about 11.9 wt. % cobalt.

In some embodiments the niobium bearing superalloy includes 4.3 wt. % aluminum, about 12.3 wt. % chromium, about 8.6 wt. % niobium, about 2.4 wt. % molybdenum, about 2.3 wt. % tungsten, about 3.0 wt. % tantalum and about 11.9 wt. % cobalt.

In some embodiments the niobium bearing superalloy includes 4.1 wt. % aluminum, about 12.3 wt. % chromium, about 7.1 wt. % niobium, about 2.4 wt. % molybdenum, about 2.3 wt. % tungsten, about 3.1 wt. % tantalum and about 17.9 wt. % cobalt.

In some embodiments the niobium bearing superalloy includes 4.1 wt. % aluminum, about 12.3 wt. % chromium, about 7.1 wt. % niobium, about 2.4 wt. % molybdenum, about 2.3 wt. % tungsten, about 3.1 wt. % tantalum and about 11.9 wt. % cobalt.

In some embodiments the niobium bearing superalloy includes 4.1 wt. % aluminum, about 10.5 wt. % chromium, about 7.0 wt. % niobium, about 2.4 wt. % molybdenum, about 2.3 wt. % tungsten, about 3.0 wt. % tantalum and about 17.9 wt. % cobalt.

In some embodiments the niobium bearing superalloy includes 3.6 wt. % aluminum, about 12.1 wt. % chromium, about 7.0 wt. % niobium, about 2.4 wt. % molybdenum, about 2.3 wt. % tungsten, about 3.0 wt. % tantalum and about 17.7 wt. % cobalt.

In some embodiments the niobium bearing superalloy has a microstructure of essentially gamma phase and gamma prime phase.

In some embodiments the niobium bearing superalloy has a microstructure of essentially gamma phase and gamma prime phase, the volume percentage of gamma prime phase is about 30% to about 60% and the balance of the microstructure is gamma phase.

In some embodiments the niobium bearing superalloy has a microstructure of essentially gamma phase and gamma prime phase, the volume percentage of gamma prime phase is about 45% to about 50% and the balance of the microstructure is gamma phase.

In some embodiments the niobium bearing superalloy has a microstructure including gamma phase, gamma prime phase and less than about 5 volume percent delta, delta variant and eta phases.

In some embodiments the niobium bearing superalloy has less than about 2 volume percent delta, delta variant and eta phases.

A superalloy may include aluminum, niobium, tantalum and titanium, wherein the atomic fraction of aluminum is about 50% or more of the combined atomic fraction of aluminum, niobium, tantalum and titanium.

The following numbered embodiments are contemplated and are non-limiting:

1. A niobium bearing superalloy consisting of 2.2 to 4 wt. % aluminum, 0.01 to 0.05 wt. % boron, 0.02 to 0.06 wt. % carbon, 6 to 15 wt. % chromium, 0 to 20 wt. % cobalt, 0 to 0.5 wt. % hafnium, 1 to 3 wt. % molybdenum, 7.2 to 16 wt. % niobium, 0 to 0.6 wt. % silicon, 1 to 5 wt. % tantalum, 0 to 1.5 wt. % titanium, 1 to 3 wt. % tungsten, 0.04 to 0.1 wt. % zirconium and the balance nickel and incidental impurities.

2. A niobium bearing superalloy according to clause 1 consisting of 2.8 to 4 wt. % aluminum, 0.01 to 0.05 wt. % boron, 0.02 to 0.06 wt. % carbon, 10 to 15 wt. % chromium, 8 to 20 wt. % cobalt, 0 to 0.5 wt. % hafnium, 1 to 3 wt. % molybdenum, 7.2 to 12.5 wt. % niobium, 0 to 0.6 wt. % silicon, 1 to 5 wt. % tantalum, 0 to 0.5 wt. % titanium, 1 to 3 wt. % tungsten, 0.04 to 0.1 wt. % zirconium and the balance nickel and incidental impurities.

3. A niobium bearing superalloy according to any of the preceding clauses consisting of 3.2 to 3.6 wt. % aluminum, 0.01 to 0.05 wt. % boron, 0.02 to 0.06 wt. % carbon, 11 to 13.5 wt. % chromium, 10 to 20 wt. % cobalt, 0 to 0.5 wt. % hafnium, 1 to 3 wt. % molybdenum, 7.2 to 12.5 wt. % niobium, 0 to 0.6 wt. % silicon, 1 to 5 wt. % tantalum, 0 to 0.5 wt. % titanium, 1 to 3 wt. % tungsten, 0.04 to 0.1 wt. % zirconium and the balance nickel and incidental impurities.

4. A niobium bearing superalloy according to any of the preceding clauses including 3.3 wt. % aluminum, 9.0 wt. % chromium and 9.6 wt. % niobium.

5. A niobium bearing superalloy according to any of the preceding clauses including 3.8 wt. % aluminum, 9.1 wt. % chromium and 8.1 wt. % niobium.

6. A niobium bearing superalloy according to any of the preceding clauses including 2.8 wt. % aluminum, 8.9 wt. % chromium and 11.1 wt. % niobium.

7. A niobium bearing superalloy according to any of the preceding clauses including 3.2 wt. % aluminum, 4.5 wt. % chromium and 9.6 wt. % niobium.

8. A niobium bearing superalloy according to any of the preceding clauses including 3.3 wt. % aluminum, 13.6 wt. % chromium and 9.7 wt. % niobium.

9. A niobium bearing superalloy according to any of the preceding clauses including 3.3 wt. % aluminum, 9.0 wt. % chromium and 9.6 wt. % niobium.

10. A niobium bearing superalloy according to any of the preceding clauses including 3.2 wt. % aluminum, 8.8 wt. % chromium and 8.7 wt. % niobium.

11. A niobium bearing superalloy according to any of the preceding clauses including 3.2 wt. % aluminum, 8.8 wt. % chromium, 8.7 wt. % niobium, 3.1 wt. % tantalum and 18.0 wt. % cobalt.

12. A niobium bearing superalloy according to any of the preceding clauses including 3.1 wt. % aluminum, 8.6 wt. % chromium, 8.5 wt. % niobium, 2.4 wt. % molybdenum, 2.3 wt. % tungsten, 3.0 wt. % tantalum and 17.6 wt. % cobalt.

13. A niobium bearing superalloy according to any of the preceding clauses including 3.2 wt. % aluminum, 8.7 wt. % chromium, 9.3 wt. % niobium, 2.4 wt. % molybdenum, 2.3 wt. % tungsten, 1.5 wt. % tantalum and 17.7 wt. % cobalt.

14. A niobium bearing superalloy according to any of the preceding clauses including 3.1 wt. % aluminum, 8.5 wt. % chromium, 7.6 wt. % niobium, 2.4 wt. % molybdenum, 2.3 wt. % tungsten, 4.5 wt. % tantalum and 17.4 wt. % cobalt.

15. A niobium bearing superalloy according to any of the preceding clauses including 3.4 wt. % aluminum, 12.1 wt. % chromium, 8.5 wt. % niobium, 2.4 wt. % molybdenum, 2.3 wt. % tungsten, 3.0 wt. % tantalum and 17.7 wt. % cobalt.

16. A niobium bearing superalloy according to any of the preceding clauses including 3.4 wt. % aluminum, 12.1 wt. % chromium, 8.5 wt. % niobium, 2.4 wt. % molybdenum, 2.3 wt. % tungsten and 3.0 wt. % tantalum.

17. A niobium bearing superalloy according to any of the preceding clauses including 3.4 wt. % aluminum, 8.6 wt. % chromium, 8.5 wt. % niobium, 2.4 wt. % molybdenum, 2.3 wt. % tungsten and 3.0 wt. % tantalum.

18. A niobium bearing superalloy according to any of the preceding clauses including 3.4 wt. % aluminum, 12.1 wt. % chromium, 8.5 wt. % niobium, 2.4 wt. % molybdenum, 2.3 wt. % tungsten, 3.0 wt. % tantalum and 8.8 wt. % cobalt.

19. A niobium bearing superalloy according to any of the preceding clauses including 3.4 wt. % aluminum, 12.2 wt. % chromium, 9.4 wt. % niobium, 2.4 wt. % molybdenum, 2.3 wt. % tungsten and 1.5 wt. % tantalum.

20. A niobium bearing superalloy according to any of the preceding clauses including 3.6 wt. % aluminum, 12.2 wt. % chromium, 8.5 wt. % niobium, 2.4 wt. % molybdenum, 2.3 wt. % tungsten and 3.0 wt. % tantalum.

21. A niobium bearing superalloy including about of 2.2 to 4 wt. % aluminum, about 0.01 to 0.05 wt. % boron, about 0.02 to 0.06 wt. % carbon, about 6 to 15 wt. % chromium, about 0 to 20 wt. % cobalt, about 0 to 0.5 wt. % hafnium, about 1 to 3 wt. % molybdenum, about 7.2 to 16 wt. % niobium, about 0 to 0.6 wt. % silicon, about 1 to 5 wt. % tantalum, about 0 to 1.5 wt. % titanium, about 1 to 3 wt. % tungsten, about 0.04 to 0.1 wt. % zirconium and the balance nickel and incidental impurities.

22. A niobium bearing superalloy according to clause 21 including about 2.8 to 4 wt. % aluminum, about 0.01 to 0.05 wt. % boron, about 0.02 to 0.06 wt. % carbon, about 10 to 15 wt. % chromium, about 8 to 20 wt. % cobalt, about 0 to 0.5 wt. % hafnium, about 1 to 3 wt. % molybdenum, about 7.2 to 12.5 wt. % niobium, about 0 to 0.6 wt. % silicon, about 1 to 5 wt. % tantalum, about 0 to 0.5 wt. % titanium, about 1 to 3 wt. % tungsten, about 0.04 to 0.1 wt. % zirconium and the balance nickel and incidental impurities.

23. A niobium bearing superalloy according to any of the preceding clauses including about 3.2 to 3.6 wt. % aluminum, about 0.01 to 0.05 wt. % boron, about 0.02 to 0.06 wt. % carbon, about 11 to 13.5 wt. % chromium, about 10 to 20 wt. % cobalt, about 0 to 0.5 wt. % hafnium, about 1 to 3 wt. % molybdenum, about 7.2 to 12.5 wt. % niobium, about 0 to 0.6 wt. % silicon, about 1 to 5 wt. % tantalum, about 0 to 0.5 wt. % titanium, about 1 to 3 wt. % tungsten, about 0.04 to 0.1 wt. % zirconium and the balance nickel and incidental impurities.

24. A niobium bearing superalloy according to any of the preceding clauses including about 3.3 wt. % aluminum, about 9.0 wt. % chromium and about 9.6 wt. % niobium.

25. A niobium bearing superalloy according to any of the preceding clauses including about 3.8 wt. % aluminum, about 9.1 wt. % chromium and about 8.1 wt. % niobium.

26. A niobium bearing superalloy according to any of the preceding clauses including about 2.8 wt. % aluminum, about 8.9 wt. % chromium and about 11.1 wt. % niobium.

27. niobium bearing superalloy according to any of the preceding clauses including about 3.2 wt. % aluminum, about 4.5 wt. % chromium and about 9.6 wt. % niobium.

28. A niobium bearing superalloy according to any of the preceding clauses including about 3.3 wt. % aluminum, about 13.6 wt. % chromium and about 9.7 wt. % niobium.

29. A niobium bearing superalloy according to any of the preceding clauses including about 3.3 wt. % aluminum, about 9.0 wt. % chromium and about 9.6 wt. % niobium.

30. A niobium bearing superalloy according to any of the preceding clauses including about 3.2 wt. % aluminum, about 8.8 wt. % chromium and about 8.7 wt. % niobium.

31. A niobium bearing superalloy according to any of the preceding clauses including about 3.2 wt. % aluminum, about 8.8 wt. % chromium, about 8.7 wt. % niobium, about 3.1 wt. % tantalum and about 18.0 wt. % cobalt.

32. A niobium bearing superalloy according to any of the preceding clauses including about 3.1 wt. % aluminum, about 8.6 wt. % chromium, about 8.5 wt. % niobium, about 2.4 wt. % molybdenum, about 2.3 wt. % tungsten, about 3.0 wt. % tantalum and about 17.6 wt. % cobalt.

33. A niobium bearing superalloy according to any of the preceding clauses including about 3.2 wt. % aluminum, about 8.7 wt. % chromium, about 9.3 wt. % niobium, about 2.4 wt. % molybdenum, about 2.3 wt. % tungsten, about 1.5 wt. % tantalum and about 17.7 wt. % cobalt.

34. A niobium bearing superalloy according to any of the preceding clauses including about 3.1 wt. % aluminum, about 8.5 wt. % chromium, about 7.6 wt. % niobium, about 2.4 wt. % molybdenum, about 2.3 wt. % tungsten, about 4.5 wt. % tantalum and about 17.4 wt. % cobalt.

35. A niobium bearing superalloy according to any of the preceding clauses including about 3.4 wt. % aluminum, about 12.1 wt. % chromium, about 8.5 wt. % niobium, about 2.4 wt. % molybdenum, about 2.3 wt. % tungsten, about 3.0 wt. % tantalum and about 17.7 wt. % cobalt.

36. A niobium bearing superalloy according to any of the preceding clauses including about 3.4 wt. % aluminum, about 12.1 wt. % chromium, about 8.5 wt. % niobium, about 2.4 wt. % molybdenum, about 2.3 wt. % tungsten and about 3.0 wt. % tantalum.

37. A niobium bearing superalloy according to any of the preceding clauses including about 3.4 wt. % aluminum, about 8.6 wt. % chromium, about 8.5 wt. % niobium, about 2.4 wt. % molybdenum, about 2.3 wt. % tungsten and about 3.0 wt. % tantalum.

38. A niobium bearing superalloy according to any of the preceding clauses including about 3.4 wt. % aluminum, about 12.1 wt. % chromium, about 8.5 wt. % niobium, about 2.4 wt. % molybdenum, about 2.3 wt. % tungsten, about 3.0 wt. % tantalum and about 8.8 wt. % cobalt.

39. A niobium bearing superalloy according to any of the preceding clauses including about 3.4 wt. % aluminum, about 12.2 wt. % chromium, about 9.4 wt. % niobium, about 2.4 wt. % molybdenum, about 2.3 wt. % tungsten and about 1.5 wt. % tantalum.

40. A niobium bearing superalloy according to any of the preceding clauses including about 3.6 wt. % aluminum, about 12.2 wt. % chromium, about 8.5 wt. % niobium, about 2.4 wt. % molybdenum, about 2.3 wt. % tungsten and about 3.0 wt. % tantalum.

41. A niobium bearing superalloy consisting of 2.5 to 5 wt. % aluminum, 0.01 to 0.05 wt. % boron, 0.02 to 0.06 wt. % carbon, 8 to 15 wt. % chromium, 0 to 20 wt. % cobalt, 0 to 0.5 wt. % hafnium, 1 to 3 wt. % molybdenum, 6 to 12 wt. % niobium, 0 to 0.6 wt. % silicon, 1 to 5 wt. % tantalum, 0 to 1.5 wt. % titanium, 1 to 3 wt. % tungsten, 0.04 to 0.1 wt. % zirconium and the balance nickel and incidental impurities.

42. A niobium bearing superalloy according to clause 41 consisting of 3 to 4.5 wt. % aluminum, 0.01 to 0.05 wt. % boron, 0.02 to 0.06 wt. % carbon, 10 to 15 wt. % chromium, 8 to 20 wt. % cobalt, 0 to 0.5 wt. % hafnium, 1 to 3 wt. % molybdenum, 6 to 9.5 wt. % niobium, 0 to 0.6 wt. % silicon, 1 to 5 wt. % tantalum, 0 to 0.5 wt. % titanium, 1 to 3 wt. % tungsten, 0.04 to 0.1 wt. % zirconium and the balance nickel and incidental impurities.

43. A niobium bearing superalloy according to any of the preceding clauses consisting of 3.5 to 4.5 wt. % aluminum, 0.01 to 0.05 wt. % boron, 0.02 to 0.06 wt. % carbon, 11 to 13.5 wt. % chromium, 10 to 18 wt. % cobalt, 0 to 0.5 wt. % hafnium, 1 to 3 wt. % molybdenum, 6.5 to 8.5 wt. % niobium, 0 to 0.6 wt. % silicon, 1 to 5 wt. % tantalum, 0 to 0.5 wt. % titanium, 1 to 3 wt. % tungsten, 0.04 to 0.1 wt. % zirconium and the balance nickel and incidental impurities.

44. A niobium bearing superalloy according to any of the preceding clauses including 3.4 wt. % aluminum, 12.1 wt. % chromium, 8.5 wt. % niobium, 2.4 wt. % molybdenum, 2.3 wt. % tungsten, 3.0 wt. % tantalum and 11.8 wt. % cobalt.

45. A niobium bearing superalloy according to any of the preceding clauses including 3.7 wt. % aluminum, 12.4 wt. % chromium, 8.7 wt. % niobium, 2.5 wt. % molybdenum, 2.3 wt. % tungsten, 3.1 wt. % tantalum and 16.1 wt. % cobalt.

46. A niobium bearing superalloy according to any of the preceding clauses including 3.9 wt. % aluminum, 12.4 wt. % chromium, 8.7 wt. % niobium, 2.5 wt. % molybdenum, 2.4 wt. % tungsten, 3.1 wt. % tantalum and 16.1 wt. % cobalt.

47. A niobium bearing superalloy according to any of the preceding clauses including 3.6 wt. % aluminum, 12.1 wt. % chromium, 9.3 wt. % niobium, 2.4 wt. % molybdenum, 2.3 wt. % tungsten, and 3.0 wt. % tantalum.

48. A niobium bearing superalloy according to any of the preceding clauses including 3.6 wt. % aluminum, 12.2 wt. % chromium, 8.5 wt. % niobium, 2.4 wt. % molybdenum, 2.3 wt. % tungsten, 3.0 wt. % tantalum and 11.8 wt. % cobalt.

49. A niobium bearing superalloy according to any of the preceding clauses including 3.8 wt. % aluminum, 12.2 wt. % chromium, 8.6 wt. % niobium, 2.4 wt. % molybdenum, 2.3 wt. % tungsten, 3.0 wt. % tantalum and 11.8 wt. % cobalt.

50. A niobium bearing superalloy according to any of the preceding clauses including 4.1 wt. % aluminum, 12.2 wt. % chromium, 8.6 wt. % niobium, 2.4 wt. % molybdenum, 2.3 wt. % tungsten, 3.0 wt. % tantalum and 11.9 wt. % cobalt.

51. A niobium bearing superalloy according to any of the preceding clauses including 4.3 wt. % aluminum, 12.3 wt. % chromium, 8.6 wt. % niobium, 2.4 wt. % molybdenum, 2.3 wt. % tungsten, 3.0 wt. % tantalum and 11.9 wt. % cobalt.

52. A niobium bearing superalloy according to any of the preceding clauses including 4.1 wt. % aluminum, 12.3 wt. % chromium, 7.1 wt. % niobium, 2.4 wt. % molybdenum, 2.3 wt. % tungsten, 3.1 wt. % tantalum and 17.9 wt. % cobalt.

53. A niobium bearing superalloy according to any of the preceding clauses including 4.1 wt. % aluminum, 12.3 wt. % chromium, 7.1 wt. % niobium, 2.4 wt. % molybdenum, 2.3 wt. % tungsten, 3.1 wt. % tantalum and 11.9 wt. % cobalt.

54. A niobium bearing superalloy according to any of the preceding clauses including 4.1 wt. % aluminum, 10.5 wt. % chromium, 7.0 wt. % niobium, 2.4 wt. % molybdenum, 2.3 wt. % tungsten, 3.0 wt. % tantalum and 17.9 wt. % cobalt.

55. A niobium bearing superalloy according to any of the preceding clauses including 3.6 wt. % aluminum, 12.1 wt. % chromium, 7.0 wt. % niobium, 2.4 wt. % molybdenum, 2.3 wt. % tungsten, 3.0 wt. % tantalum and 17.7 wt. % cobalt.

56. A niobium bearing superalloy including about of 2.5 to 5 wt. % aluminum, about 0.01 to 0.05 wt. % boron, about 0.02 to 0.06 wt. % carbon, about 8 to 15 wt. % chromium, about 0 to 20 wt. % cobalt, about 0 to 0.5 wt. % hafnium, about 1 to 3 wt. % molybdenum, about 6 to 12 wt. % niobium, about 0 to 0.6 wt. % silicon, about 1 to 5 wt. % tantalum, about 0 to 1.5 wt. % titanium, about 1 to 3 wt. % tungsten, about 0.04 to 0.1 wt. % zirconium and the balance nickel and incidental impurities.

57. A niobium bearing superalloy according to clause 56 including about 3 to 4.5 wt. % aluminum, about 0.01 to 0.05 wt. % boron, about 0.02 to 0.06 wt. % carbon, about 10 to 15 wt. % chromium, about 8 to 20 wt. % cobalt, about 0 to 0.5 wt. % hafnium, about 1 to 3 wt. % molybdenum, about 6 to 9.5 wt. % niobium, about 0 to 0.6 wt. % silicon, about 1 to 5 wt. % tantalum, about 0 to 0.5 wt. % titanium, about 1 to 3 wt. % tungsten, about 0.04 to 0.1 wt. % zirconium and the balance nickel and incidental impurities.

58. A niobium bearing superalloy according to any of the preceding clauses including about 3.5 to 4.5 wt. % aluminum, about 0.01 to 0.05 wt. % boron, about 0.02 to 0.06 wt. % carbon, about 11 to 13.5 wt. % chromium, about 10 to 18 wt. % cobalt, about 0 to 0.5 wt. % hafnium, about 1 to 3 wt. % molybdenum, about 6.5 to 8.5 wt. % niobium, about 0 to 0.6 wt. % silicon, about 1 to 5 wt. % tantalum, about 0 to 0.5 wt. % titanium, about 1 to 3 wt. % tungsten, about 0.04 to 0.1 wt. % zirconium and the balance nickel and incidental impurities.

59. A niobium bearing superalloy according to any of the preceding clauses including about 3.4 wt. % aluminum, about 12.1 wt. % chromium, about 8.5 wt. % niobium, about 2.4 wt. % molybdenum, about 2.3 wt. % tungsten, about 3.0 wt. % tantalum and about 11.8 wt. % cobalt.

60. A niobium bearing superalloy according to any of the preceding clauses including about 3.7 wt. % aluminum, about 12.4 wt. % chromium, about 8.7 wt. % niobium, about 2.5 wt. % molybdenum, about 2.3 wt. % tungsten, about 3.1 wt. % tantalum and about 16.1 wt. % cobalt.

61. A niobium bearing superalloy according to any of the preceding clauses including about 3.9 wt. % aluminum, about 12.4 wt. % chromium, about 8.7 wt. % niobium, about 2.5 wt. % molybdenum, about 2.4 wt. % tungsten, about 3.1 wt. % tantalum and about 16.1 wt. % cobalt.

62. A niobium bearing superalloy according to any of the preceding clauses including about 3.6 wt. % aluminum, about 12.1 wt. % chromium, about 9.3 wt. % niobium, about 2.4 wt. % molybdenum, about 2.3 wt. % tungsten, and about 3.0 wt. % tantalum.

63. A niobium bearing superalloy according to any of the preceding clauses including about 3.6 wt. % aluminum, about 12.2 wt. % chromium, about 8.5 wt. % niobium, about 2.4 wt. % molybdenum, about 2.3 wt. % tungsten, about 3.0 wt. % tantalum and about 11.8 wt. % cobalt.

64. A niobium bearing superalloy according to any of the preceding clauses including about 3.8 wt. % aluminum, about 12.2 wt. % chromium, about 8.6 wt. % niobium, about 2.4 wt. % molybdenum, about 2.3 wt. % tungsten, about 3.0 wt. % tantalum and about 11.8 wt. % cobalt.

65. A niobium bearing superalloy according to any of the preceding clauses including about 4.1 wt. % aluminum, about 12.2 wt. % chromium, about 8.6 wt. % niobium, about 2.4 wt. % molybdenum, about 2.3 wt. % tungsten, about 3.0 wt. % tantalum and about 11.9 wt. % cobalt.

66. A niobium bearing superalloy according to any of the preceding clauses including about 4.3 wt. % aluminum, about 12.3 wt. % chromium, about 8.6 wt. % niobium, about 2.4 wt. % molybdenum, about 2.3 wt. % tungsten, about 3.0 wt. % tantalum and about 11.9 wt. % cobalt.

67. A niobium bearing superalloy according to any of the preceding clauses including about 4.1 wt. % aluminum, about 12.3 wt. % chromium, about 7.1 wt. % niobium, about 2.4 wt. % molybdenum, about 2.3 wt. % tungsten, about 3.1 wt. % tantalum and about 17.9 wt. % cobalt.

68. A niobium bearing superalloy according to any of the preceding clauses including about 4.1 wt. % aluminum, about 12.3 wt. % chromium, about 7.1 wt. % niobium, about 2.4 wt. % molybdenum, about 2.3 wt. % tungsten, about 3.1 wt. % tantalum and about 11.9 wt. % cobalt.

69. A niobium bearing superalloy according to any of the preceding clauses including about 4.1 wt. % aluminum, about 10.5 wt. % chromium, about 7.0 wt. % niobium, about 2.4 wt. % molybdenum, about 2.3 wt. % tungsten, about 3.0 wt. % tantalum and about 17.9 wt. % cobalt.

70. A niobium bearing superalloy according to any of the preceding clauses including about 3.6 wt. % aluminum, about 12.1 wt. % chromium, about 7.0 wt. % niobium, about 2.4 wt. % molybdenum, about 2.3 wt. % tungsten, about 3.0 wt. % tantalum and about 17.7 wt. % cobalt.

71. A niobium bearing superalloy according to any of the preceding clauses having a microstructure of essentially gamma phase and gamma prime phase.

72. A niobium bearing superalloy according to any of the preceding clauses having a microstructure of essentially gamma phase and gamma prime phase, wherein the volume percentage of gamma prime phase is about 30% to about 60% and the balance of the microstructure is gamma phase.

73. A niobium bearing superalloy according to any of the preceding clauses having a microstructure of essentially gamma phase and gamma prime phase, wherein the volume percentage of gamma prime phase is about 45% to about 50% and the balance of the microstructure is gamma phase.

74. A niobium bearing superalloy according to any of the preceding clauses having a microstructure including gamma phase, gamma prime phase and less than about 5 volume percent delta, delta variant and eta phases.

75. A niobium bearing superalloy according to clause 74, having less than about 2 volume percent delta, delta variant and eta phases.

76. A superalloy including aluminum, niobium, tantalum and titanium, wherein the atomic fraction of aluminum is about 50% or more of the combined atomic fraction of aluminum, niobium, tantalum and titanium.

These and other features of the present disclosure will become more apparent from the following description of the illustrative embodiments.

DETAILED DESCRIPTION

Figure 1A:
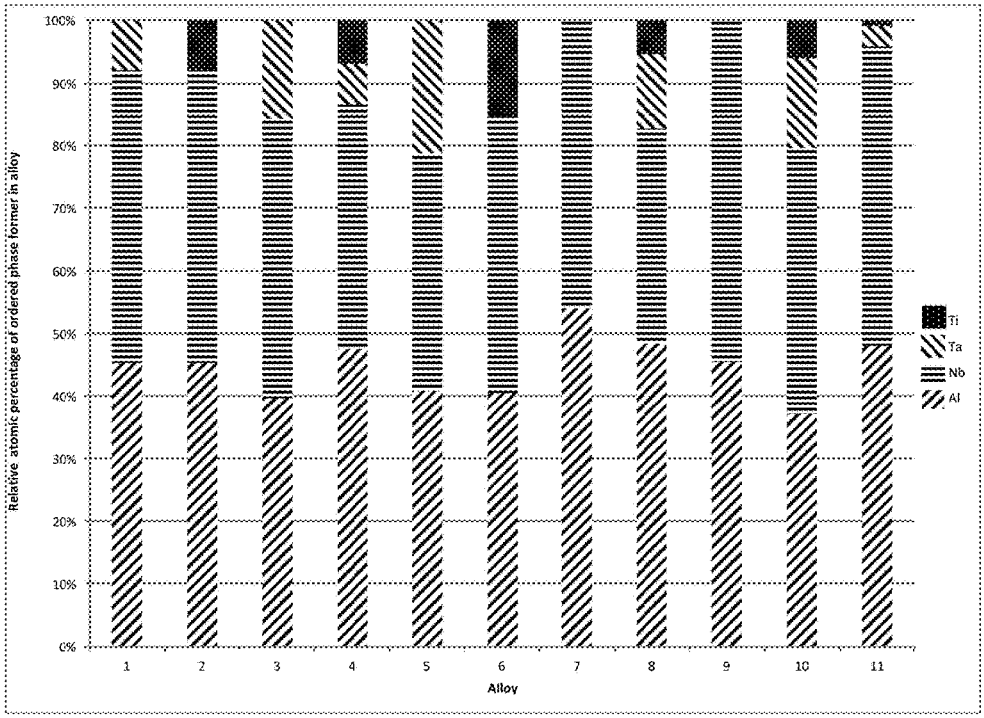
FIGS. 1A-1C are graphs of arc melted alloy compositions according to certain embodiments of the present disclosure. Starting at the bottom of each graph, the bars indicate the relative atomic percentages for aluminum (Al), niobium (Nb), tantalum (Ta), and titanium (Ti).

For the purposes of promoting an understanding of the principles of the disclosure, reference will now be made to a number of illustrative embodiments illustrated in the drawings and specific language will be used to describe the same.

The present disclosure relates to a class of nickel-base superalloys having gamma prime strengthening precipitates in a gamma matrix which are stable at high temperature, more resistant to coarsening during processing and service, and contain little or no tertiary incoherent phases, such as delta, delta variants and eta. By maintaining a fine dispersion of precipitates that resist coarsening, strength and resistance to strength degradation at high temperatures are enhanced. By avoiding these tertiary incoherent phases, potential issues with void formation at the incoherent interfaces are avoided. Additionally, these tertiary incoherent phases can adversely affect ductility. These alloys can operate at higher temperatures with improved stability and ductility as compared to known alloys and are intended to operate for prolonged periods of time at high stresses and temperatures up to at least about 825° C.

Alloys of the present disclosure include niobium-bearing nickel-base alloys having gamma and gamma prime as the primary phases and include carbide and boride grain boundary strengthening. Microstructures of these niobium bearing alloys typically consist of gamma prime phase precipitates in the gamma phase. Such alloys have desirable strength and improved resistance to degradation at elevated temperatures as compared to conventional superalloys.

The distinguishing characteristic of nickel based superalloys is the presence of one or more ordered intermetallic phase precipitates of composition $Ni_3X$, where X can be aluminum, niobium, titanium, and tantalum. The matrix gamma phase is disordered face centered cubic. Gamma prime is a ductile ordered intermetallic phase with a face centered cubic structure. The composition of the gamma prime phase is typically $Ni_3Al$ and it is the primary strengthening precipitate in most nickel based superalloys. However, depending on the composition of the alloy, other elements, such as titanium, tantalum and niobium, may substitute for the Al atoms. The gamma prime phase is typically spherical or cubic and the particles are coherent with the gamma matrix which provides maximum strengthening benefit. However, degenerate shapes can occur in larger particles under certain conditions with an attendant loss of coherency and strengthening benefit.

As the relative amount of aluminum in an alloy decreases versus the other ordered phase forming elements, alternative ordered phases can form in preference to or in conjunction with gamma prime. Alloys of the present disclosure are intended to maximize strength and stability of the gamma and gamma prime phases.

The delta phase has an orthorhombic structure and limited ductility. The composition of the delta phase is typically $Ni_3Nb$. Depending on the composition of the alloy, titanium and tantalum may substitute for the Nb atoms and, under certain conditions, Al may substitute for the Nb atoms to form $Ni_6AlNb$ with a hexagonal structure. The delta phase may be irregularly shaped globular particles or highly acicular needles or lamellae.

The eta phase has a hexagonal structure and the composition of the eta phase is typically $Ni_3Ti$. However, aluminum, tantalum and niobium may substitute for titanium. The eta phase is generally acicular, but the aspect ratio of the phase can vary considerably.

Alloys of the present disclosure may contain a number of other elements in addition to Ni, Nb, Ti, Ta and Al. The addition of chromium increases resistance to oxidation and corrosion and retards diffusional coarsening of gamma prime. Chromium preferentially partitions to the matrix gamma phase. However, the amount of Cr should be limited to no more than about 15 wt. % and, preferably, to no more than about 13 wt. % due to its propensity to combine with refractory elements in the alloy and form topologically close-packed (TCP) phases like sigma. These TCP phases are embrittling and are therefore generally undesirable. Cobalt generally lowers the gamma prime solvus and the stacking fault energy which aids processability, creep rupture strength, and, at some temperatures, fatigue strength. Cobalt also retards diffusional coarsening of gamma prime. However, Co can also aid formation of TCP phases and should therefore be limited to not more than about 20 wt. %. Molybdenum and tungsten are solid solution strengtheners for both the gamma and gamma prime phases and provide diffusional coarsening resistance. Boron, carbon, and zirconium may be added to strengthen the grain boundaries by forming nonmetallic particles at the grain boundaries. These elements can also counteract the deleterious effects of grain impurity segregates like sulfur and oxygen by acting as a diffusion barrier. Hafnium and silicon may be used to improve dwell fatigue and environmental resistance, respectively. In general, all the metallic phases exhibit some degree of solubility for the other alloying elements in the material.

Alloys of the present disclosure have lower niobium content than traditional ternary eutectic gamma-gamma prime-delta alloys and higher niobium content than typical nickel-base superalloys. Certain alloys of the present disclosure have a niobium content similar to that of certain composite niobium bearing superalloys having lower niobium content as compared to other composite niobium bearing superalloys. However, the composition of the remaining elements in alloys of the present disclosure is modified to avoid formation of the alternative ordered phases that constitute an integral part of composite niobium bearing superalloys. In certain embodiments, alloys of the present disclosure include less than about 5 volume percent delta, delta variant and eta phases. In some embodiments, alloys of the present disclosure include less than about 2 volume percent delta, delta variant and eta phases. In certain embodiments, alloys of the present disclosure have niobium levels of about 7 weight % to about 12 weight %. In certain embodiments, alloys of the present disclosure have niobium levels of about 6 weight % to about 9 weight %. In certain embodiments of the disclosure, the volume percentage of gamma prime is about 30% to about 60% and the volume percentage of gamma is about 70% to about 40%. In other embodiments, the volume percentage of gamma prime is about 45% to about 50% and the volume percentage of gamma is about 55% to about 50%.

Figure 1B:
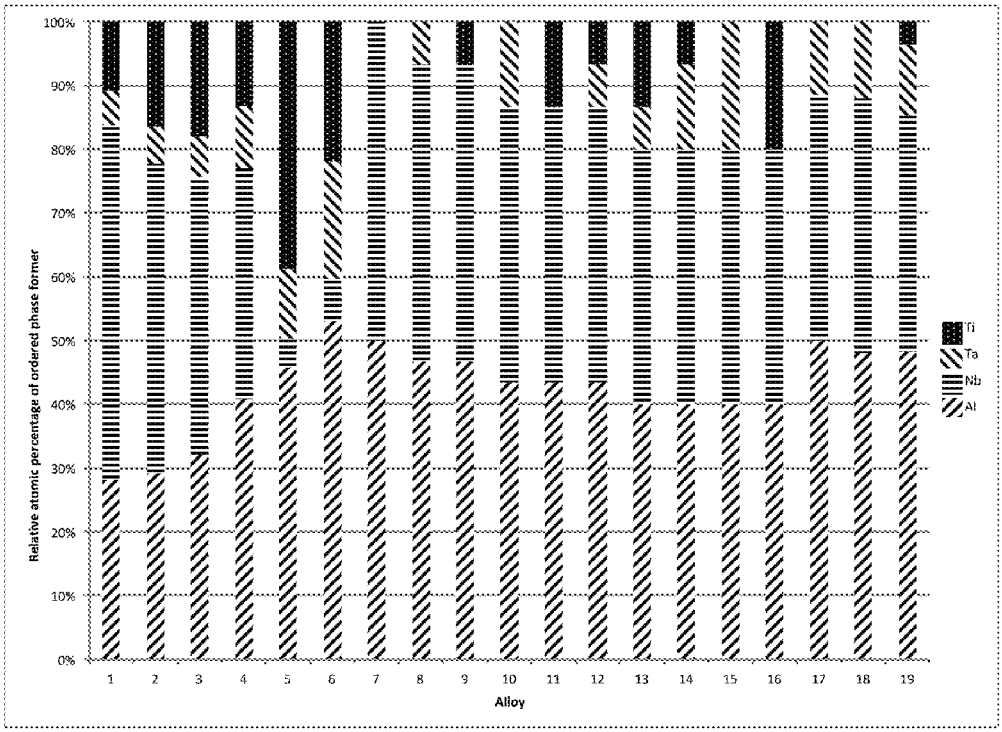
Figure 1C:
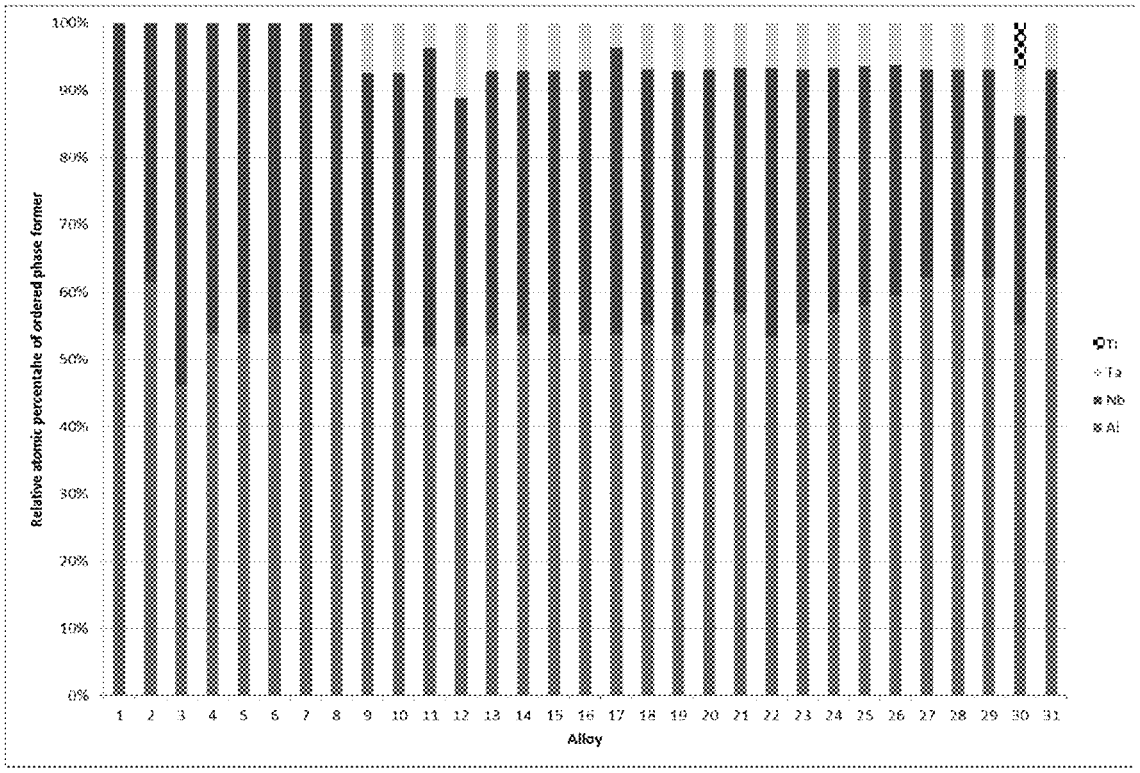

The approximate nominal compositional range ranges for which high levels of niobium could be employed to retard diffusional coarsening while maintaining a two phase structure were estimated from the matrix composition of ternary eutectic and composite niobium bearing alloys as shown in FIG. 1A and then refined by producing small arc melted buttons of specific alloy compositions. The buttons did not contain the typical small grain boundary strengthening additions of carbon, boron, and zirconium. The compositions were selected in an attempt to produce gamma-gamma prime alloys while eliminating delta, delta variant and eta phase formation. The alloys for which delta, delta variant or eta phase were observed are shown in FIG. 1B and the alloys for which no delta, delta variant or eta phase were observed are shown in FIG. 1C. The level of ordered phase forming element is stated in atomic percent, as the inventors have found elemental atomic fraction to be more predictive of phasal stability than elemental weight fraction. The atomic fraction of aluminum in the matrix of the ternary eutectic and composite niobium bearing superalloys relative to the overall atomic level of all the ordered phase forming elements (Al, Nb, Ta, and Ti) was generally between 40% to 50%. However, it was recognized that the analysis technique was likely to have captured some third phases within the sample volume and therefore to be under predicting the level of aluminum required to avoid the third phases in bulk material. The arc melted alloys represented in FIGS. 1B and 1C show that relative aluminum atomic fraction is preferably around about 50% or more of the total ordered phase forming element content.

While relative atomic fraction of aluminum is the primary factor influencing the presence or absence of delta, delta variant and/or or eta phase, the other alloying elements in the material also effect the stability of gamma prime relative to the other ordered phases. In particular, titanium in the presence of high niobium levels stabilizes eta phase and thus needs to be limited to lower levels than are typically employed for nickel based superalloy disk materials.

Table 1 shows the model alloys for which no delta, delta variant, or eta phase was observed.

TABLE 1

| Alloy | Al | Cr | Nb | Mo | W | Ta | Co | Ni |
|---|---|---|---|---|---|---|---|---|
| 1 | 3.3 | 9.0 | 9.6 | — | — | — | — | Balance |
| 2 | 3.8 | 9.1 | 8.1 | — | — | — | — | Balance |
| 3 | 2.8 | 8.9 | 11.1 | — | — | — | — | Balance |

TABLE 1-continued

| Alloy | Al | Cr | Nb | Mo | W | Ta | Co | Ni |
|---|---|---|---|---|---|---|---|---|
| 4 | 3.2 | 4.5 | 9.6 | — | — | — | — | Balance |
| 5 | 3.3 | 13.6 | 9.7 | — | — | — | — | Balance |
| 6 | 3.3 | 9.0 | 9.6 | — | — | — | — | Balance |
| 7 | 3.3 | 9.0 | 9.6 | — | — | — | — | Balance |
| 8 | 3.3 | 9.0 | 9.6 | — | — | — | — | Balance |
| 9 | 3.2 | 8.8 | 8.7 | — | — | 3.1 | 18.0 | Balance |
| 10 | 3.1 | 8.6 | 8.5 | 2.4 | 2.3 | 3.0 | 17.6 | Balance |
| 11 | 3.2 | 8.7 | 9.3 | 2.4 | 2.3 | 1.5 | 17.7 | Balance |
| 12 | 3.1 | 8.5 | 7.6 | 2.4 | 2.3 | 4.5 | 17.4 | Balance |
| 13 | 3.4 | 12.1 | 8.5 | 2.4 | 2.3 | 3.0 | 17.7 | Balance |
| 14 | 3.4 | 12.1 | 8.5 | 2.4 | 2.3 | 3.0 | — | Balance |
| 15 | 3.4 | 8.6 | 8.5 | 2.4 | 2.3 | 3.0 | — | Balance |
| 16 | 3.4 | 12.1 | 8.5 | 2.4 | 2.3 | 3.0 | 8.8 | Balance |
| 17 | 3.4 | 12.2 | 9.4 | 2.4 | 2.3 | 1.5 | — | Balance |
| 18 | 3.6 | 12.2 | 8.5 | 2.4 | 2.3 | 3.0 | — | Balance |
| 19 | 3.4 | 12.1 | 8.5 | 2.4 | 2.3 | 3.0 | 11.8 | Balance |
| 20 | 3.7 | 12.4 | 8.7 | 2.5 | 2.3 | 3.1 | 16.1 | Balance |
| 21 | 3.9 | 12.4 | 8.7 | 2.5 | 2.4 | 3.1 | 16.1 | Balance |
| 22 | 3.6 | 12.1 | 9.3 | 2.4 | 2.3 | 3.0 | 0 | Balance |
| 23 | 3.6 | 12.2 | 8.5 | 2.4 | 2.3 | 3.0 | 11.8 | Balance |
| 24 | 3.8 | 12.2 | 8.6 | 2.4 | 2.3 | 3.0 | 11.8 | Balance |
| 25 | 4.1 | 12.2 | 8.6 | 2.4 | 2.3 | 3.0 | 11.9 | Balance |
| 26 | 4.3 | 12.3 | 8.6 | 2.4 | 2.3 | 3.0 | 11.9 | Balance |
| 27 | 4.1 | 12.3 | 7.1 | 2.4 | 2.3 | 3.1 | 17.9 | Balance |
| 28 | 4.1 | 12.3 | 7.1 | 2.4 | 2.3 | 3.1 | 11.9 | Balance |
| 29 | 4.1 | 10.5 | 7.0 | 2.4 | 2.3 | 3.0 | 17.9 | Balance |
| 30 | 3.6 | 12.1 | 7.0 | 2.4 | 2.3 | 3.0 | 17.7 | Balance |

Figure 2A:
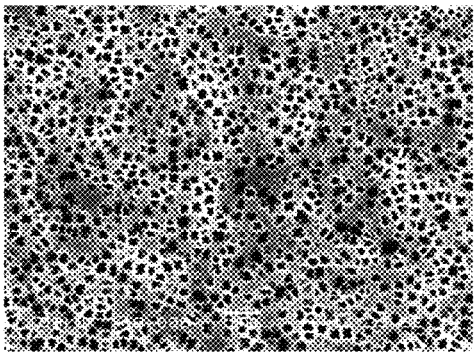
FIGS. 2A-2D are micrographs of an arc melted alloy according to certain embodiments of the present disclosure.
Figure 2B:
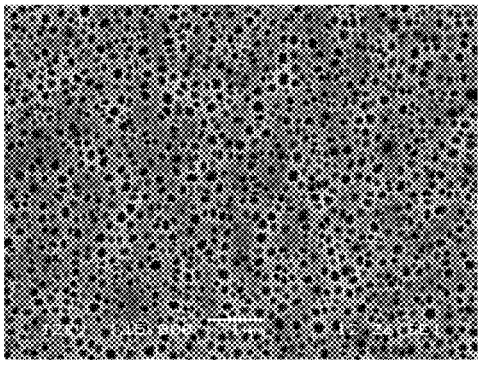
Figure 2C:
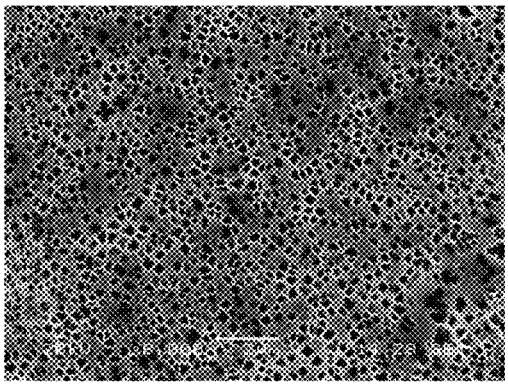
Figure 2D:
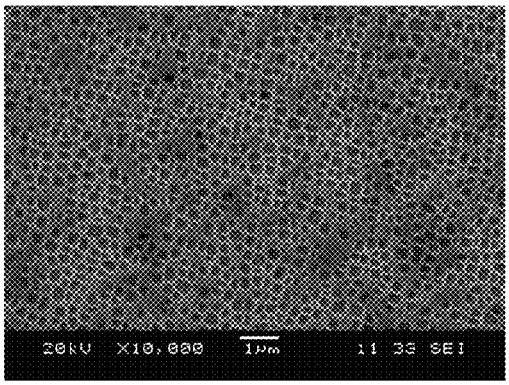

FIG. 2A shows the microstructure of arc melted alloy 13 from Table 1 after solution heat treatment. The material was solution heat treated at 1110° C. and furnace cooled from the solution temperature at an average cooling rate of approximately 0.3° C. per second to simulate approximate worse case cooling conditions in large turbine engine disks. FIG. 2B shows the microstructure of arc melted alloy 13 from Table 1 after solution heat treatment, furnace cooling, and aging at 850° C. for 16 hours. FIG. 2C shows the microstructure of a powder compact alloy of similar composition to alloy 13 but including grain boundary strengthening elements after solution heat treatment and aging similar to the FIG. 2B material. FIG. 2D shows the microstructure of arc melted alloy 29 from Table 1 after solution heat treatment and aging similar to the FIG. 2B material. The gray material is the gamma phase with small darker gray gamma prime precipitates within the gamma phase. The white band around the gamma prime particles is a reflective artifact from the specimen preparation etching which preferentially removed gamma prime.

Figure 3A:
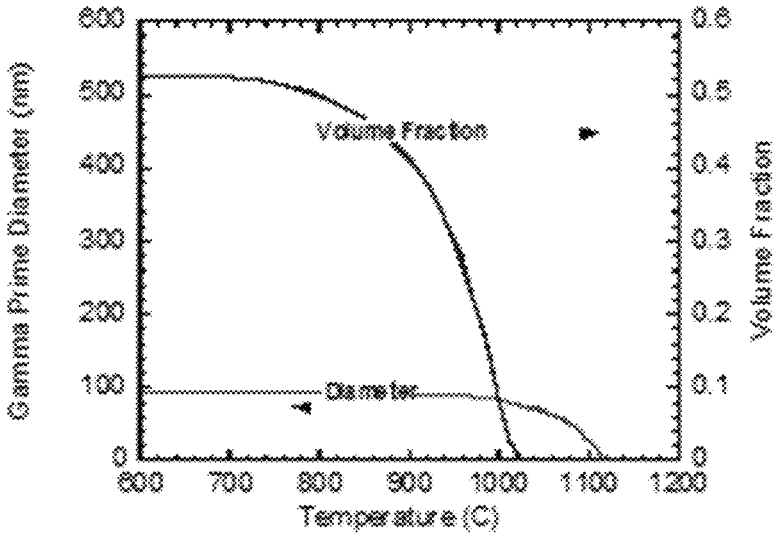
FIGS. 3A-3D are predicted gamma prime size and volume fraction according to certain embodiments of the present disclosure.
Figure 3B:
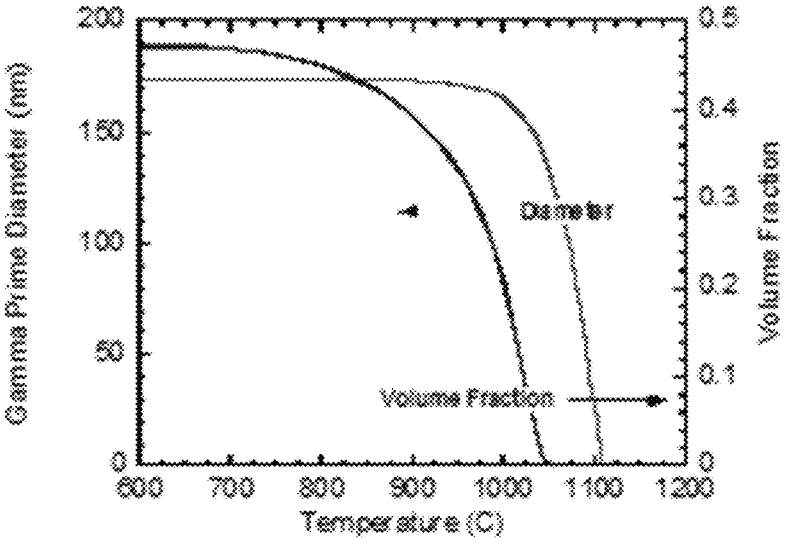
Figure 3C:
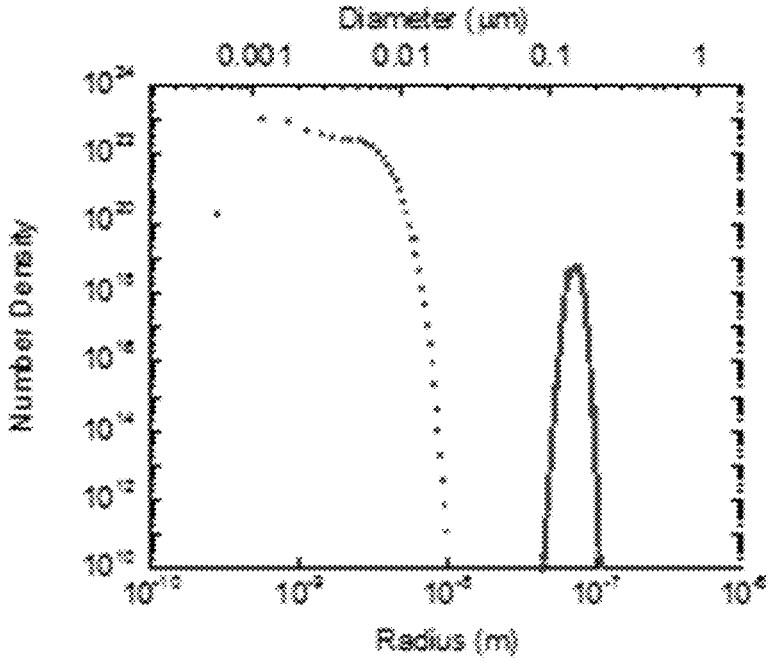
Figure 3D:
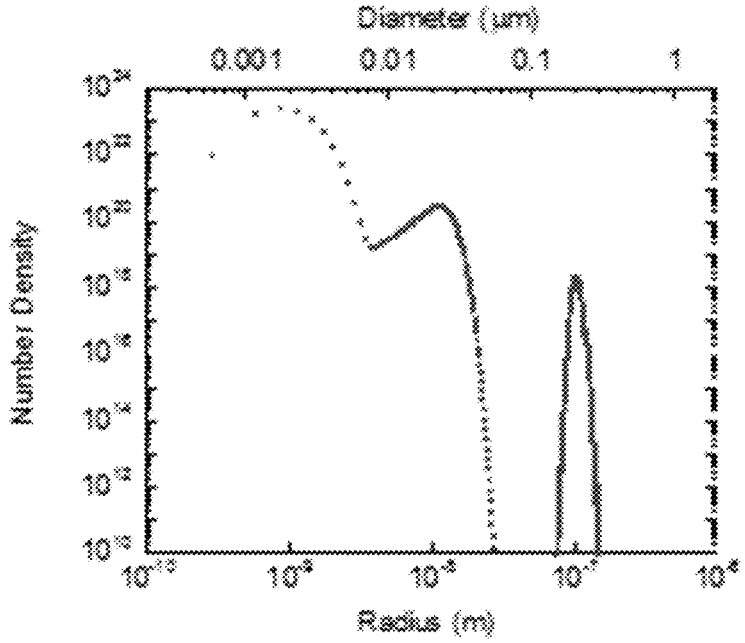

FIGS. 3A-3D show the predicted gamma prime morphology for alloy 13 from Table 1 compared to a prior art alloy for a solution and aging heat treatment which would be typical for a large turbine disk. The predictions were performed using commercial thermodynamic and kinetic software codes from CompuTherm LLC. FIGS. 3A and 3B compare the predicted evolution of gamma prime volume fraction and average gamma prime size during cooling from solution heat treatment of alloy 13 and the prior art alloy. FIGS. 3C and 3D compare the predicted evolution of gamma prime size distribution after solution and aging heat treatment of alloy 13 and the prior art alloy. Alloy 13 provides a much smaller average gamma prime particle size after the heat treatment. Those skilled in the art will recognize the considerable strength benefit such a pronounced change in gamma prime morphology would produce.

Figure 4:
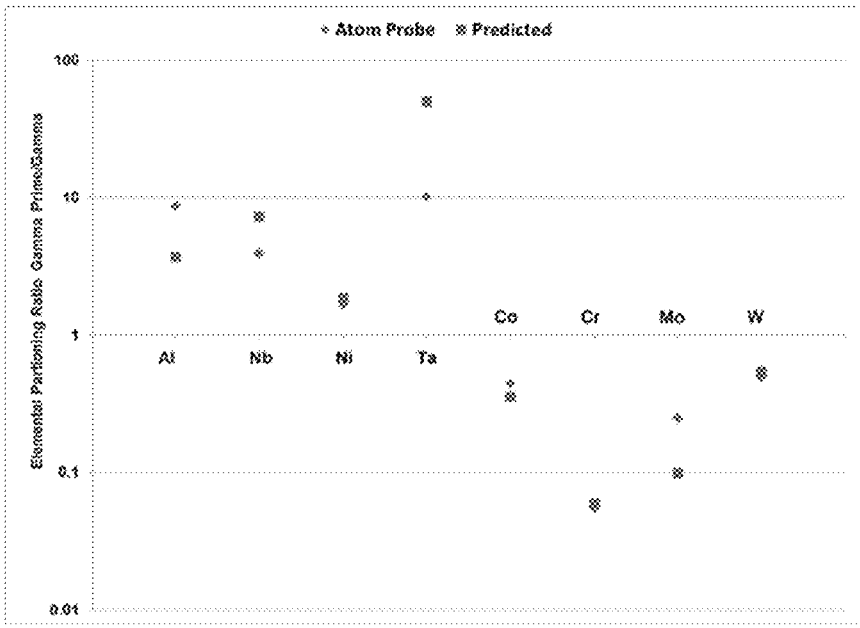
FIG. 4 is quantitative atom probe analyses to determine the partitioning behavior of the major alloying elements between the gamma and gamma prime phases according to certain embodiments of the present disclosure.

Microstructural evaluations revealed that the gamma prime volume fractions of these alloys were somewhat below the predicted levels. Quantitative atom probe analysis was conducted on the compacted powder material of alloy 13 comprising nearly four hundred million atoms to determine the partitioning behavior of the major alloying elements between the gamma and gamma prime phases. These results are summarized in FIG. 4. Niobium exhibited a lower partitioning to the gamma prime than predicted and the opposite trend was observed for aluminum. Consequently, many of the later-tested alloys shown in Table 1 examined higher aluminum contents in an effort to restore the gamma prime volume fraction in the alloys to the desired level of 45% to 50%. FIG. 2D shows that this was achieved.

Figure 5:
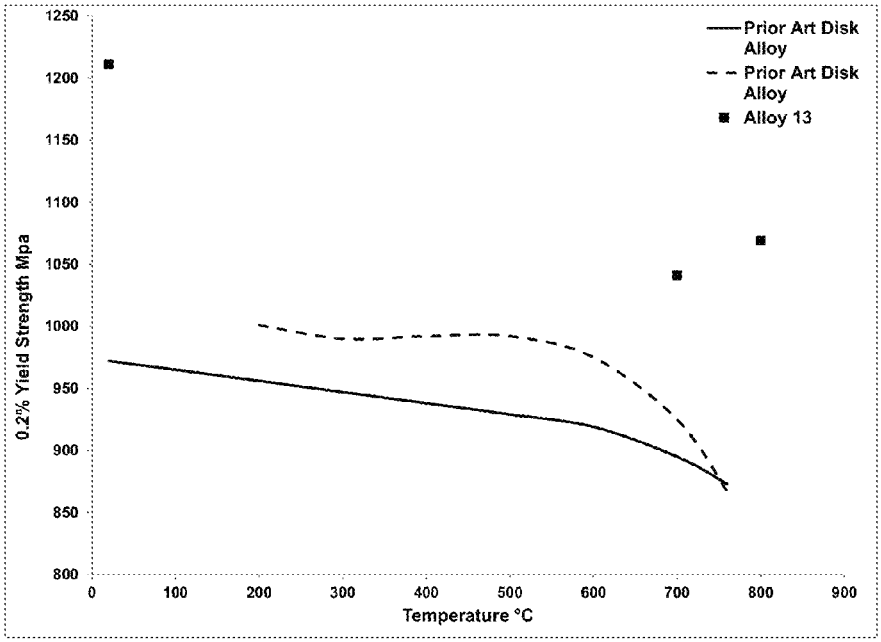
FIG. 5 is the variation in yield strength with temperature according to certain embodiments of the present disclosure after forging and solution and aging heat treatments compared with a number of prior art alloys.

FIG. 5 shows the variation in yield strength with temperature for one of the alloys from Table 1 produced from compacted powder after forging and solution and aging heat treatments compared with a number of prior art alloys. As shown in FIG. 5, the strength and strength retention versus temperature for the embodiment of certain embodiments of the present disclosure are superior to the prior art alloys.

Alloys of the present disclosure may be manufactured in a number of ways. For example, the alloys may be manufactured using powder metallurgy typically used to produce high strength, high temperature disk alloys. Cast and wrought processing techniques can also be used.

While the disclosure has been illustrated and described in detail in the foregoing drawings and description, the same is to be considered as exemplary and not restrictive in character, it being understood that only illustrative embodiments thereof have been shown and described and that all changes and modifications that come within the spirit of the disclosure are desired to be protected.

What is claimed is:

1. A nickel-based niobium bearing superalloy including about of 2.2 to 4 wt. % aluminum, about 0.01 to 0.05 wt. % boron, about 0.02 to 0.06 wt. % carbon, about 6 to 15 wt. % chromium, about 0 to 20 wt. % cobalt, about 0 to 0.5 wt. % hafnium, about 1 to 3 wt. % molybdenum, about 7.2 to 16 wt. % niobium, about 0 to 0.6 wt. % silicon, about 1 to 5 wt. % tantalum, about 0 to 1.5 wt. % titanium, about 1 to 3 wt. % tungsten, about 0.04 to 0.1 wt. % zirconium and the balance nickel and incidental impurities, wherein the nickel-based niobium bearing superalloy has a microstructure of essentially gamma phase and gamma prime phase, and wherein the volume percentage of gamma prime phase is about 45% to about 50% and the balance of the microstructure is gamma phase.

2. A niobium bearing superalloy according to claim 1 including about 3.3 wt. % aluminum, about 9.0 wt. % chromium and about 9.6 wt. % niobium.

3. A niobium bearing superalloy according to claim 1 including about 3.8 wt. % aluminum, about 9.1 wt. % chromium and about 8.1 wt. % niobium.

4. A niobium bearing superalloy according to claim 1 including about 2.8 wt. % aluminum, about 8.9 wt. % chromium and about 11.1 wt. % niobium.

5. A niobium bearing superalloy according to claim 1 including about 3.3 wt. % aluminum, about 13.6 wt. % chromium and about 9.7 wt. % niobium.

6. A niobium bearing superalloy according to claim 1 including about 3.3 wt. % aluminum, about 9.0 wt. % chromium and about 9.6 wt. % niobium.

7. A niobium bearing superalloy according to claim 1 including about 3.2 wt. % aluminum, about 8.8 wt. % chromium and about 8.7 wt. % niobium.

8. A nickel-based niobium bearing superalloy consisting of 2.5 to 5 wt. % aluminum, 0.01 to 0.05 wt. % boron, 0.02 to 0.06 wt. % carbon, 8 to 15 wt. % chromium, 0 to 20 wt. % cobalt, 0 to 0.5 wt. % hafnium, 1 to 3 wt. % molybdenum, 6 to 12 wt. % niobium, 0 to 0.6 wt. % silicon, 1 to 5 wt. % tantalum, 0 to 1.5 wt. % titanium, 1 to 3 wt. % tungsten, 0.04-0.1 wt % zirconium and the balance nickel and incidental impurities, wherein the nickel-based niobium bearing superalloy has a microstructure of essentially gamma phase and gamma prime phase, and wherein the volume percentage of gamma prime phase is about 45% to about 50% and the balance of the microstructure is gamma phase.

9. A nickel-based niobium bearing superalloy according to claim 8 consisting of 3 to 4.5 wt. % aluminum, 0.01 to 0.05 wt. % boron, 0.02 to 0.06 wt. % carbon, 10 to 15 wt. % chromium, 8 to 20 wt. % cobalt, 0 to 0.5 wt. % hafnium, 1 to 3 wt. % molybdenum, 6 to 9.5 wt. % niobium, 0 to 0.6 wt. % silicon, 1 to 5 wt. % tantalum, 0 to 0.5 wt. % titanium, 1 to 3 wt. % tungsten, 0.04-0.1 wt % zirconium and the balance nickel and incidental impurities.

10. A nickel-based niobium bearing superalloy according to claim 8 consisting of 3.5 to 4.5 wt. % aluminum, 0.01 to 0.05 wt. % boron, 0.02 to 0.06 wt. % carbon, 11 to 13.5 wt. % chromium, 10 to 18 wt. % cobalt, 0 to 0.5 wt. % hafnium, 1 to 3 wt. % molybdenum, 6.5 to 8.5 wt. % niobium, 0 to 0.6 wt. % silicon, 1 to 5 wt. % tantalum, 0 to 0.5 wt. % titanium, 1 to 3 wt. % tungsten, 0.04-0.1 wt % zirconium and the balance nickel and incidental impurities.

11. A nickel-based niobium bearing superalloy including about of 2.5 to 5 wt. % aluminum, about 0.01 to 0.05 wt. % boron, about 0.02 to 0.06 wt. % carbon, about 8 to 15 wt. % chromium, about 0 to 20 wt. % cobalt, about 0 to 0.5 wt. % hafnium, about 1 to 3 wt. % molybdenum, about 6 to 12 wt. % niobium, about 0 to 0.6 wt. % silicon, about 1 to 5 wt. % tantalum, about 0 to 1.5 wt. % titanium, about 1 to 3 wt. % tungsten, about 0.04 to 0.1 wt. % zirconium and the balance nickel and incidental impurities, wherein the nickel-based niobium bearing superalloy has a microstructure of essentially gamma phase and gamma prime phase, and wherein the volume percentage of gamma prime phase is about 45% to about 50% and the balance of the microstructure is gamma phase.

12. A nickel-based niobium bearing superalloy according to claim 11 including about 3 to 4.5 wt. % aluminum, about 0.01 to 0.05 wt. % boron, about 0.02 to 0.06 wt. % carbon, about 10 to 15 wt. % chromium, about 8 to 20 wt. % cobalt, about 0 to 0.5 wt. % hafnium, about 1 to 3 wt. % molybdenum, about 6 to 9.5 wt. % niobium, about 0 to 0.6 wt. % silicon, about 1 to 5 wt. % tantalum, about 0 to 0.5 wt. % titanium, about 1 to 3 wt. % tungsten, about 0.04 to 0.1 wt. % zirconium and the balance nickel and incidental impurities.

13. A nickel-based niobium bearing superalloy according to claim 11 including about 3.5 to 4.5 wt. % aluminum, about 0.01 to 0.05 wt. % boron, about 0.02 to 0.06 wt. % carbon, about 11 to 13.5 wt. % chromium, about 10 to 18 wt. % cobalt, about 0 to 0.5 wt. % hafnium, about 1 to 3 wt. % molybdenum, about 6.5 to 8.5 wt. % niobium, about 0 to 0.6 wt. % silicon, about 1 to 5 wt. % tantalum, about 0 to 0.5 wt. % titanium, about 1 to 3 wt. % tungsten, about 0.04 to 0.1 wt. % zirconium and the balance nickel and incidental impurities.

14. A nickel-based niobium bearing superalloy according to claim 11 including about 3.4 wt. % aluminum, about 12.1 wt. % chromium, about 8.5 wt. % niobium, about 2.4 wt. % molybdenum, about 2.3 wt. % tungsten and about 3.0 wt. % tantalum.

15. A nickel-based niobium bearing superalloy according to claim 11 including about 4.1 wt. % aluminum, about 12.2 wt. % chromium, about 8.6 wt. % niobium, about 2.4 wt. % molybdenum, about 2.3 wt. % tungsten and about 3.0 wt. % tantalum.

16. A nickel-based niobium bearing superalloy according to claim 11 including about 4.1 wt. % aluminum, about 10.5 wt. % chromium, about 7.0 wt. % niobium, about 2.4 wt. % molybdenum, about 2.3 wt. % tungsten and about 3.0 wt. % tantalum.

17. A nickel-based niobium bearing superalloy according to claim 11 including about 3.6 wt. % aluminum, about 12.1 wt. % chromium, about 7.0 wt. % niobium, about 2.4 wt. % molybdenum, about 2.3 wt. % tungsten and about 3.0 wt. % tantalum.

18. A niobium bearing superalloy according to claim 11 including about 3.3 wt. % aluminum, about 9.0 wt. % chromium and about 9.6 wt. % niobium.

19. A niobium bearing superalloy according to claim 11 including about 3.8 wt. % aluminum, about 9.1 wt. % chromium and about 8.1 wt. % niobium.

20. A niobium bearing superalloy according to claim 11 including about 3.2 wt. % aluminum, about 8.8 wt. % chromium and about 8.7 wt. % niobium.

* * * * *